US012357103B2

(12) United States Patent
Miller, Jr.

(10) Patent No.: US 12,357,103 B2
(45) Date of Patent: Jul. 15, 2025

(54) UNIVERSAL AIR SURFACE

(71) Applicant: Sizewise Rentals, L.L.C., Lenexa, KS (US)

(72) Inventor: Craig Salvatore Miller, Jr., Corona, CA (US)

(73) Assignee: Sizewise Rentals, L.L.C., Lenexa, KS (US)

( * ) Notice: Subject to any disclaimer, the term of this patent is extended or adjusted under 35 U.S.C. 154(b) by 226 days.

(21) Appl. No.: 18/171,564

(22) Filed: Feb. 20, 2023

(65) Prior Publication Data

US 2023/0263313 A1 Aug. 24, 2023

Related U.S. Application Data

(60) Provisional application No. 63/268,302, filed on Feb. 21, 2022.

(51) Int. Cl.

| | |
|---|---|
| ***A47C 27/10*** | (2006.01) |
| ***A47C 27/00*** | (2006.01) |
| ***A47C 27/08*** | (2006.01) |

(52) U.S. Cl.
CPC ..... *A47C 27/10* (2013.01); *A47C 27/002* (2013.01); *A47C 27/082* (2013.01)

(58) Field of Classification Search
CPC ..... A47C 27/00; A47C 27/001; A47C 27/002; A47C 27/08; A47C 27/081; A47C 27/082; A47C 27/083; A47C 27/084; A47C 27/085; A47C 27/086; A47C 27/087; A47C 27/088; A47C 27/10; A47C 27/142; A47C 27/15; A47C 27/16; A47C 27/18
See application file for complete search history.

(56) References Cited

U.S. PATENT DOCUMENTS

| | | | | | |
|---|---|---|---|---|---|
| 945,234 | A | | 1/1910 | Hinsdale | |
| 961,231 | A | * | 6/1910 | Hinsdale | A47C 27/081 297/DIG. 3 |
| 4,005,236 | A | | 1/1977 | Graebe | |
| 4,193,151 | A | * | 3/1980 | Calleance | A47C 27/085 5/915 |
| 4,279,044 | A | | 7/1981 | Douglas | |
| 4,488,322 | A | * | 12/1984 | Hunt | A47C 27/10 5/713 |
| 4,686,722 | A | * | 8/1987 | Swart | A61G 7/05769 5/713 |
| 4,722,105 | A | | 2/1988 | Douglas | |

(Continued)

*Primary Examiner* — George Sun
(74) *Attorney, Agent, or Firm* — Spencer Fane LLP

(57) ABSTRACT

A universal air surface may include a plurality of inflatable air chambers disposed in parallel arrangement with each other, wherein a first side wall and a second side wall of the plurality of inflatable air chambers are asymmetrically to each other about a central axis of the plurality of inflatable air chambers to accommodate a manifold routed adjacent to a first lower end wall of the plurality of inflatable air chambers. A first void is formed between the first lower end wall of the plurality of inflatable air chambers, a bed frame, and a first side rail. A second void is formed between the second lower end wall, the bed frame, and a second side rail; wherein a first cross sectional area of the first void is greater than a second cross sectional area of the second void. Methods of routing the manifold within the first void are disclosed.

20 Claims, 7 Drawing Sheets

(56) References Cited

U.S. PATENT DOCUMENTS 4,941,223 A * 7/1990 Santo ..... A47C 27/085 156/217
5,065,465 A * 11/1991 Nystad ..... A47C 27/085 5/687
5,815,862 A * 10/1998 Rygiel ..... A61G 7/05769 5/733
5,836,027 A 11/1998 Thomas et al.
5,907,878 A 6/1999 Thomas et al.
6,200,403 B1 3/2001 Thomas et al.
6,212,719 B1 4/2001 Thomas et al.
6,269,505 B1 * 8/2001 Wilkinson ..... A47C 27/10 5/713
6,273,866 B2 8/2001 Thomas et al.
6,547,911 B2 4/2003 Thomas et al.
6,551,450 B1 4/2003 Thomas et al.
6,848,137 B1 * 2/2005 Barnes ..... A47C 27/081 5/710
7,536,740 B1 * 5/2009 Swartz ..... A47C 27/081 5/725
7,739,760 B2 * 6/2010 Wang ..... F04D 25/166 5/177
D703,977 S * 5/2014 Roberts ..... D6/601
2001/0008029 A1 7/2001 Thomas et al.
2006/0282955 A1 * 12/2006 Gilchrest, Jr. ..... A61G 7/0525 5/713
2007/0151033 A1 * 7/2007 Wyatt ..... A61G 7/05715 5/713
2007/0234480 A1 * 10/2007 Crousore ..... A61G 7/05769 5/706
2011/0265267 A1 * 11/2011 Wang ..... A47C 20/047 5/722
2011/0271448 A1 * 11/2011 Faridoon ..... A61G 7/05784 5/655.4
2012/0252292 A1 * 10/2012 Garcia ..... A61N 5/0614 40/299.01
2014/0000040 A1 * 1/2014 Caminade ..... A47C 27/083 5/713
2014/0026325 A1 * 1/2014 Guthrie ..... A61G 7/05776 5/709
2014/0245539 A1 * 9/2014 Ooba ..... A47C 27/083 5/636
2017/0056264 A1 3/2017 Chaplin
2019/0059606 A1 * 2/2019 Huang ..... A47C 20/027
2020/0020486 A1 * 1/2020 Eidelman ..... H01G 9/06
2020/0078241 A1 * 3/2020 Chang ..... A61G 7/05776
2021/0244194 A1 * 8/2021 Adams ..... A47C 27/18
2022/0040017 A1 * 2/2022 Masouros ..... A61G 5/1043
2023/0263313 A1 8/2023 Miller, Jr.

* cited by examiner

UNIVERSAL AIR SURFACE

CROSS-REFERENCE TO RELATED APPLICATION

This application claims priority to U.S. Provisional Application No. 63/268,302 filed Feb. 21, 2022, the contents of which are hereby incorporated by reference.

TECHNICAL FIELD

The disclosed subject matter relates generally to a universal air surface and more particularly, to a plurality of inflatable air chambers having asymmetrical sidewalls.

BACKGROUND

A universal air surface may utilize a plurality of inflatable air chambers capable of independent inflation and deflation in order to control the air pressure within individual air cells. A manifold comprising a plurality of tubing assemblies may be connected between a pump system and the plurality of inflatable air chambers to provide a pressurized fluid to each of the plurality of inflatable air chambers. If the manifold is not properly accommodated proximate the plurality of inflatable air chambers, then excessive forces between the manifold and the plurality of inflatable air chambers may result in deformation, crimping, blockage, and/or breakage of the manifold and/or the plurality of inflatable air chambers. A side wall of the plurality of inflatable air chambers proximate the manifold may be tapered in a manner to accommodate the manifold in order to alleviate or avoid such excessive forces.

SUMMARY

In an embodiment, the subject matter described herein relates to a universal air surface including: a plurality of inflatable air chambers disposed in parallel arrangement with each other, wherein each of the plurality of inflatable air chambers includes: a top wall; a bottom wall disposed opposite the top wall; a head side wall connected between the top wall and the bottom wall; a foot side wall disposed opposite the head side wall, the foot side wall connected between the top wall the bottom wall; a first side wall connected between the top wall, the bottom wall, the head side wall, and the foot side wall, wherein the first side wall includes: a first upper end wall connected to the top wall and extending downwardly from the top wall; and a first lower end wall connected between the first upper end wall and the bottom wall, wherein the first lower end wall forms a first angle with the bottom wall, wherein the first lower end wall is connected to the first upper end wall at a first height above the bottom wall; and a second side wall connected between the top wall, the bottom wall, the head side wall, and the foot side wall, wherein the second side wall includes: a second upper end wall connected to the top wall and extending downwardly from the top wall; and a second lower end wall connected between the second upper end wall and the bottom wall, wherein the second lower end wall forms a second angle with the bottom wall, wherein the second lower end wall is connected to the second upper end wall at a second height above the bottom wall, wherein the first height is greater than the second height.

In an embodiment, the subject matter described herein relates to a universal air surface, wherein the first angle is greater than the second angle.

In another embodiment, the subject matter described herein relates to a universal air surface, wherein the first angle is between about 110 degrees and 115 degrees.

In an embodiment, the subject matter described herein relates to a universal air surface, wherein the first angle is about 112 degrees.

In an embodiment, the subject matter described herein relates to a universal air surface, further including a manifold connected to each of the plurality of inflatable air chambers; wherein the manifold is disposed proximate the first lower end wall.

In another embodiment, the subject matter described herein relates to a universal air surface, wherein a first void is formed between the first lower end wall, a bed frame, and a first side rail connected to the bed frame.

In an embodiment, the subject matter described herein relates to a universal air surface, wherein the first void is configured to accommodate a manifold having a maximum manifold diameter between about 3.25 inches and 3.5 inches.

In an embodiment, the subject matter described herein relates to a universal air surface, wherein a second void is formed between the second lower end wall, the bed frame, and a second side rail connected to the bed frame; wherein a first cross sectional area of the first void is greater than a second cross sectional area of the second void.

In another embodiment, the subject matter described herein relates to a universal air surface, further including a receiving sleeve demountably connected to the plurality of inflatable air chambers.

In an embodiment, the subject matter described herein relates to a universal air surface, further including an exterior cover demountably connected to the plurality of inflatable air chambers.

In an embodiment, the subject matter described herein relates to a universal air surface including: a plurality of inflatable air chambers disposed in parallel arrangement with each other, wherein each of the plurality of inflatable air chambers includes: a top wall; a bottom wall disposed opposite the top wall; a head side wall connected between the top wall and the bottom wall; a foot side wall disposed opposite the head side wall, the foot side wall connected between the top wall the bottom wall; a first side wall connected between the top wall, the bottom wall, the head side wall, and the foot side wall, wherein the first side wall includes: a first upper end wall connected to the top wall and extending downwardly from the top wall; and a first lower end wall connected between the first upper end wall and the bottom wall, wherein the first lower end wall forms a first angle with the bottom wall, wherein the first lower end wall is connected to the first upper end wall at a first height above the bottom wall; and a second side wall connected between the top wall, the bottom wall, the head side wall, and the foot side wall, wherein the second side wall includes: a second upper end wall connected to the top wall and extending downwardly from the top wall; and a second lower end wall connected between the second upper end wall and the bottom wall, wherein the second lower end wall forms a second angle with the bottom wall, wherein the second lower end wall is connected to the second upper end wall at a second height above the bottom wall, wherein the first height is greater than the second height, wherein the first angle is between about 110 degrees and 115 degrees.

In another embodiment, the subject matter described herein relates to a universal air surface, further including a manifold connected to each of the plurality of inflatable air chambers; wherein the manifold is disposed proximate the first lower end wall.

In an embodiment, the subject matter described herein relates to a method of routing a manifold adjacent to a plurality of inflatable air chambers including the steps of: providing a bed frame having a first side rail and a second side rail opposite the first side rail; providing a plurality of inflatable air chambers disposed in parallel arrangement with each other, wherein each of the plurality of inflatable air chambers includes: a top wall; a bottom wall disposed opposite the top wall; a head side wall connected between the top wall and the bottom wall; a foot side wall disposed opposite the head side wall, the foot side wall connected between the top wall the bottom wall; a first side wall connected between the top wall, the bottom wall, the head side wall, and the foot side wall, wherein the first side wall includes: a first upper end wall connected to the top wall and extending downwardly from the top wall; and a first lower end wall connected between the first upper end wall and the bottom wall, wherein the first lower end wall is connected to the first upper end wall at a first height above the bottom wall; and a second side wall connected between the top wall, the bottom wall, the head side wall, and the foot side wall, wherein the second side wall includes: a second upper end wall connected to the top wall and extending downwardly from the top wall; and a second lower end wall connected between the second upper end wall and the bottom wall, wherein the second lower end wall is connected to the second upper end wall at a second height above the bottom wall, wherein the first height is greater than the second height; connecting a manifold to each of the plurality of inflatable air chambers proximate the first lower end wall; positioning the plurality of inflatable air chambers and the manifold on the bed frame between the first side rail and the second side rail; inflating the plurality of inflatable air chambers; compressing the first upper end wall against the first side rail; compressing the second upper end wall against the second side rail; forming a first void between the first lower end wall, the first side rail, and the bed frame; and routing the manifold through the first void.

In an embodiment, the subject matter described herein relates to a method of routing a manifold adjacent to a plurality of inflatable air chambers, further including the step of forming a second void between the second lower end wall, the second side rail, and the bed frame; wherein a first cross sectional area of the first void is greater than a second cross sectional area of the second void.

In another embodiment, the subject matter described herein relates to a method of routing a manifold adjacent to a plurality of inflatable air chambers, wherein the first lower end wall forms a first angle with the bottom wall, and the second lower end wall forms a second angle with the bottom wall, wherein the first angle is greater than the second angle.

In an embodiment, the subject matter described herein relates to a method of routing a manifold adjacent to a plurality of inflatable air chambers, wherein the first angle is between about 110 degrees and 115 degrees.

In an embodiment, the subject matter described herein relates to a method of routing a manifold adjacent to a plurality of inflatable air chambers, wherein the first angle is about 112 degrees.

In another embodiment, the subject matter described herein relates to a method of routing a manifold adjacent to a plurality of inflatable air chambers, wherein the first void is configured to accommodate a manifold having a maximum manifold diameter between about 3.25 inches and 3.5 inches.

In an embodiment, the subject matter described herein relates to a method of routing a manifold adjacent to a plurality of inflatable air chambers, further including the step of inserting each of the plurality of inflatable air chambers into a receiving sleeve.

In an embodiment, the subject matter described herein relates to a method of routing a manifold adjacent to a plurality of inflatable air chambers, further including the step of inserting the plurality of inflatable air chambers into an exterior cover.

BRIEF DESCRIPTION OF THE FIGURES

The disclosed subject matter is described herein with reference to the following drawing figures, with greater emphasis being placed on clarity rather than scale.

DETAILED DESCRIPTION

Figure 1:
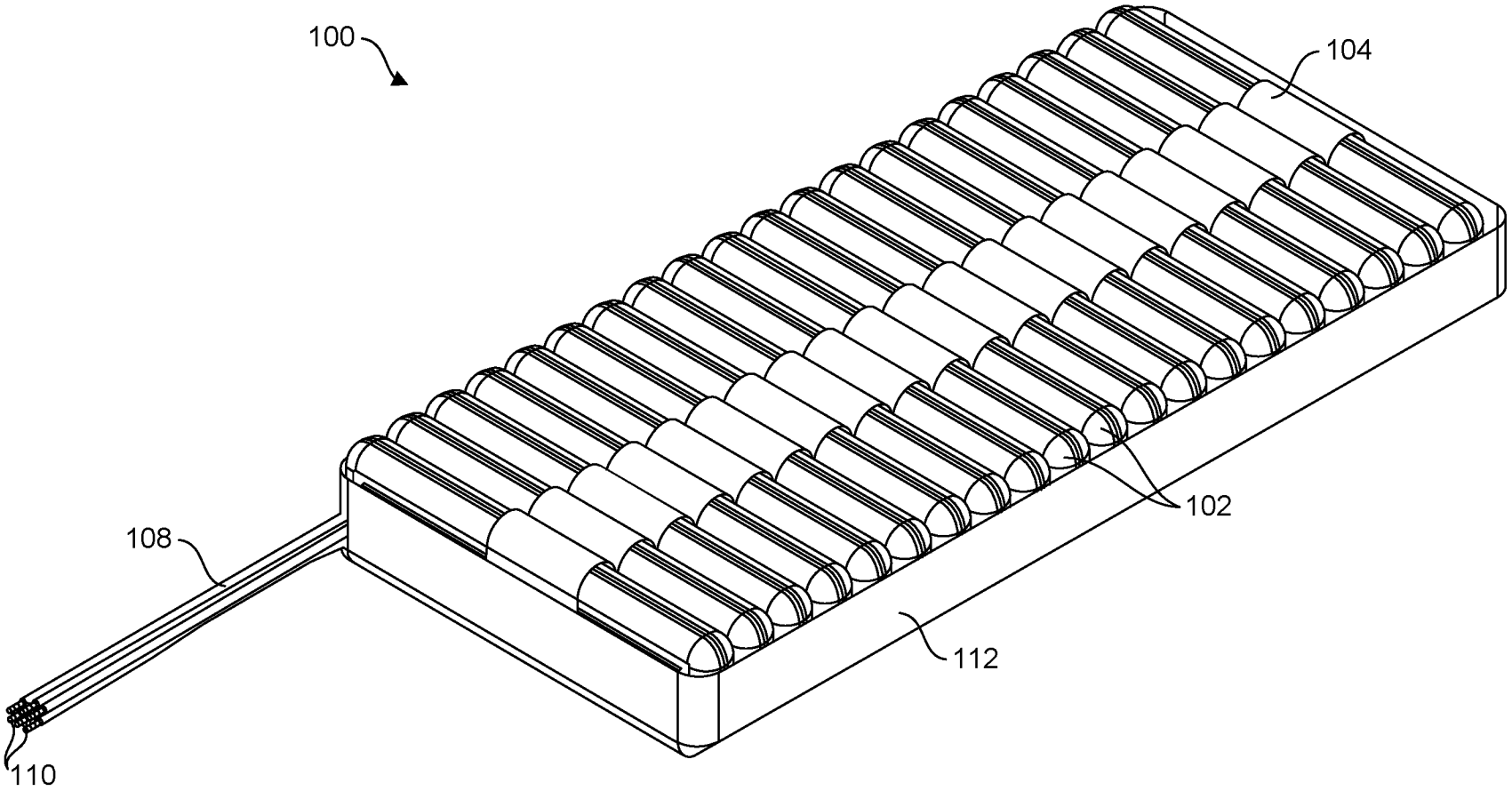
FIG. 1 is a perspective view of an embodiment of a universal air surface.
Figure 2:
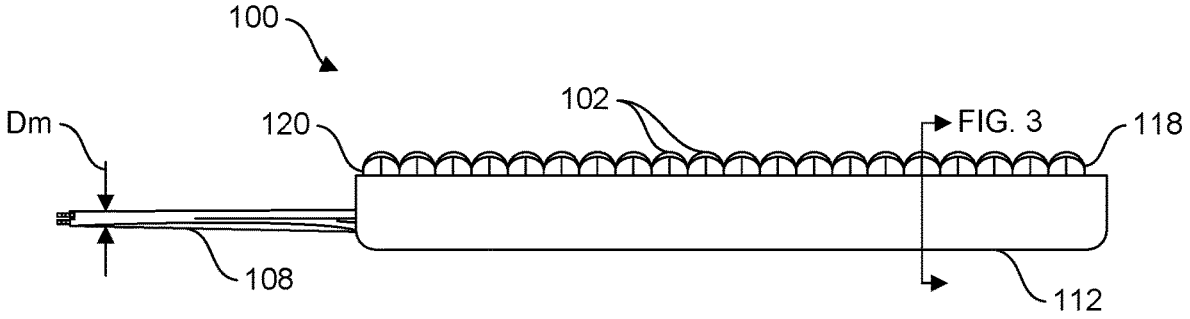
FIG. 2 is a side view of an embodiment of a universal air surface.
Figure 3:
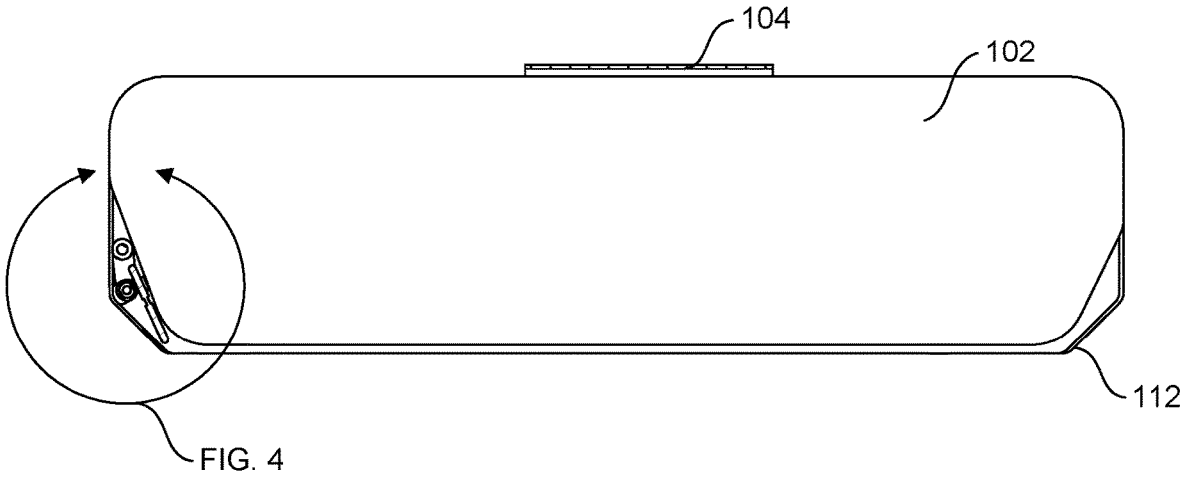
FIG. 3 is a cross-sectional view of an embodiment of a universal air surface.
Figure 4:
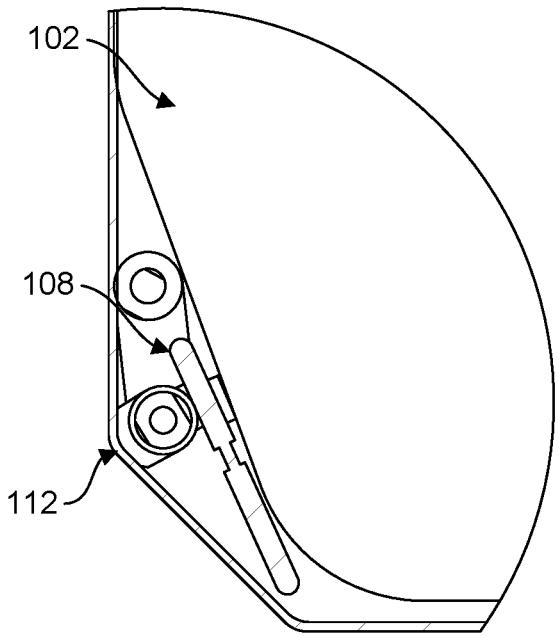
FIG. 4 is a cross-sectional view of an embodiment of a universal air surface.
Figure 5:
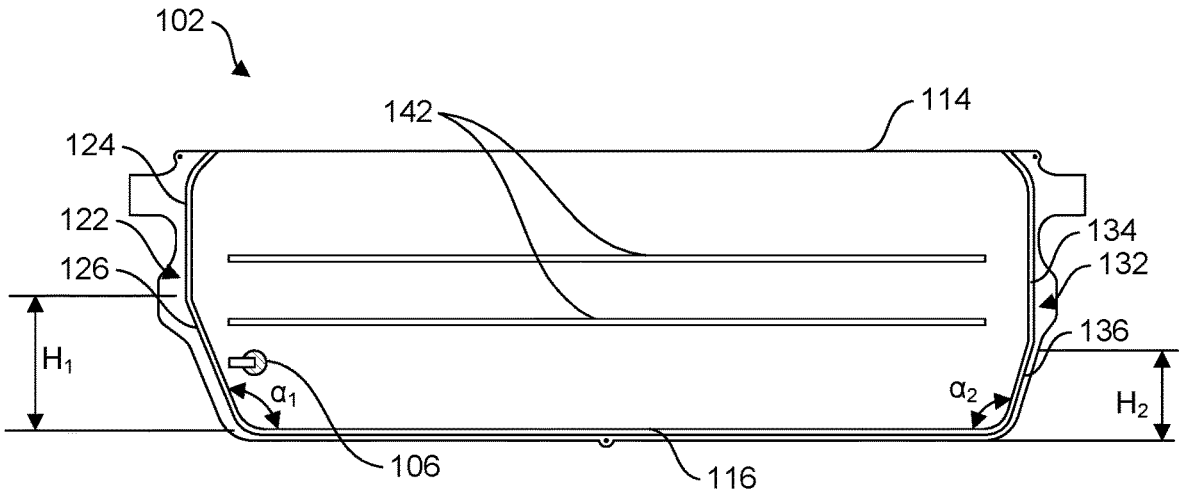
FIG. 5 is a cross-sectional view of an embodiment of a universal air surface.

As required, detailed aspects of the disclosed subject matter are disclosed herein; however, it is to be understood that the disclosed aspects are merely exemplary of the disclosed subject matter, which may be embodied in various forms. Therefore, specific structural and functional details disclosed herein are not to be interpreted as limiting, but merely as a basis for the claims and as a representative basis for teaching one skilled in the art how to variously employ the disclosed technology in virtually any appropriately detailed structure.

Although the disclosed subject matter has been disclosed with reference to various particular embodiments, it is understood that equivalents may be employed and substitutions made herein without departing from the scope of the disclosed subject matter as recited in the claims.

Certain terminology will be used in the following description, and are shown in the drawings, and will not be limiting. For example, up, down, front, back, right and left refer to the disclosed subject matter as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

The detailed description includes the disclosure of numerical ranges. Numerical ranges should be construed to provide literal support for claim limitations reciting only the upper value of a numerical range, and provide literal support for claim limitations reciting only the lower value of a numerical range.

The disclosed subject matter will now be described with reference to the drawing figures, in which like reference numerals refer to like parts throughout. For purposes of clarity in illustrating the characteristics of the present disclosed subject matter, proportional relationships of the elements have not been maintained in the figures. In some cases, the sizes of certain small components have been exaggerated for illustration.

In an embodiment of the disclosed subject matter, a universal air surface 100 is depicted in FIGS. 1-5 having a plurality of inflatable air chambers 102 made from either urethane, PVC, coated fabric capable of air holding, or other suitable materials (e.g., poly-nylon, poly film laminates, runner construction, etc.). The plurality of inflatable air chambers 102 are disposed in parallel arrangement with each other and may be held in place relative to each other by a receiving sleeve 104 that aligns and secures the plurality of inflatable air chambers 102. The receiving sleeve 104 is demountably connected to the plurality of inflatable air chambers 102.

Each of the plurality of inflatable air chambers 102 is air holding and includes an entry valve 106 to inflate/deflate one of the plurality of inflatable air chambers 102. In an embodiment, the entry valve 106 is positioned at one end of the plurality of inflatable air chambers 102 as depicted. The entry valve 106 may, for example, be an air-holding valve or a non-air-holding connector. A manifold 108 comprising a plurality of tubing assemblies 110 is configured to bring a working fluid (e.g., air) from a pumping system (not shown) to inflate or deflate the plurality of inflatable air chambers 102. Each of the plurality of tubing assemblies 110 are sized according to their application and may include an outside diameter between about ⅜ inches and ⅝ inches. At least one of the plurality of tubing assemblies 110 is connected to an entry valve 106. It is appreciated that the working fluid may not necessarily be air, as other gases or fluids could be used as well.

The plurality of inflatable air chambers 102 may be demountably connected to and held together by an exterior cover 112. The exterior cover 112 provides rigidity and stiffness to the universal air surface 100. The exterior cover 112 may be constructed from urethane, PVC, fabric, or other suitable materials.

In an embodiment of the disclosed subject matter, the manifold 108 is disposed proximate and/or adjacent to a first lower end wall 126 of the plurality of inflatable air chambers 102. The first lower end wall 126 is tapered inwardly from a first height $H_1$ towards a bottom wall 116 to accommodate the manifold 108.

Each of the plurality of inflatable air chambers 102 may comprise a top wall 114; a bottom wall 116 disposed opposite the top wall 114; a head side wall 118 connected between the top wall 114 and the bottom wall 116; a foot side wall 120 disposed opposite the head side wall 118, wherein the foot side wall 120 connected between the top wall 114 the bottom wall 116; a first side wall 122 and a second side wall 132 disposed opposite each other and connected between the top wall 114, the bottom wall 116, the head side wall 118, and the foot side wall 120. One or more internal baffles 142 may be internally connected between the head side wall 118 and the foot side wall 120 to provide structural stability and lateral rigidity to the plurality of inflatable air chambers 102.

In an embodiment of the disclosed subject matter, the first side wall 122 may include a first upper end wall 124 connected to the top wall 114 and extending downwardly from the top wall 114; and a first lower end wall 126 connected between the first upper end wall 124 and the bottom wall 116. The first lower end wall 126 forms a first angle $\alpha_1$ with the bottom wall 116. The first lower end wall 126 is connected to the first upper end wall 124 at a first height $H_1$ above the bottom wall 116.

In an embodiment of the disclosed subject matter, the second side wall 132 may include a second upper end wall 134 connected to the top wall 114 and extending downwardly from the top wall 114; and a second lower end wall 136 connected between the second upper end wall 134 and the bottom wall 116. The second lower end wall 136 forms a second angle $\alpha_2$ with the bottom wall 116. The second lower end wall 136 is connected to the second upper end wall 134 at a second height $H_2$ above the bottom wall 116. In an embodiment, the first height $H_1$ may be equal to or greater than the second height $H_2$ in order to accommodate the manifold 108 proximate the first lower end wall 126.

In an embodiment of the disclosed subject matter, the first side wall 122 and the second side wall 132 are not symmetrical about the centerline of the universal air surface 100 in order to accommodate the manifold 108 proximate the first lower end wall 126. In some embodiments, the first angle $\alpha_1$ is equal to or greater than the second angle $\alpha_2$. In other embodiments, the first angle $\alpha_1$ is between about 110 degrees and 115 degrees. In still other embodiments, the first angle $\alpha_1$ is about 112 degrees.

Figure 6:
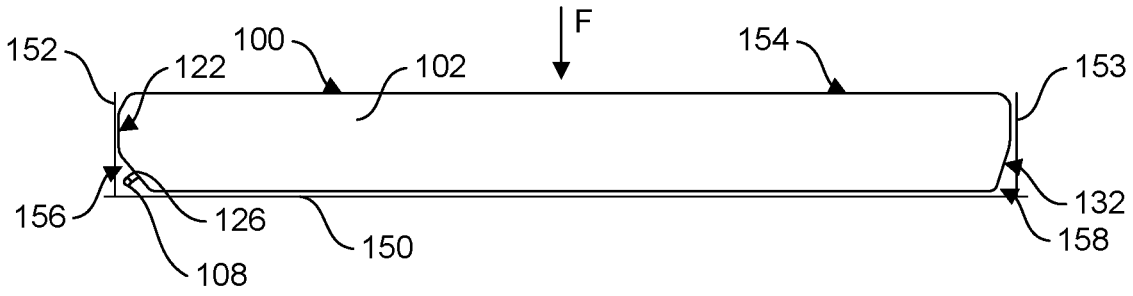
FIG. 6 is a cross-sectional view of an embodiment of a universal air surface.

Referring to FIG. 6, in an embodiment of the disclosed subject matter, the universal air surface 100 may be supported by a bed frame 150 having a first side rail 152 and a second side rail 153 opposite the first side rail 152. The bed frame 150 is configured to support the plurality of inflatable air chambers 102. A force F, such as a weight of a human body, applied to a top surface 154 of the universal air surface 100, may result in compression of the first upper end wall 124 against the first side rail 152, and compression of the second upper end wall 134 against the second side rail 153. The compression of the first upper end wall 124 against the first side rail 152 may result in an excessive force between the manifold 108 and the plurality of inflatable air chambers 102 resulting in deformation, crimping, blockage, and/or breakage of the entry valve 106, the manifold 108, and/or the plurality of inflatable air chambers 102. In order to alleviate and/or remove the excessive force between the manifold 108 and at least one of the plurality of inflatable air chambers 102, a first void 156 is formed between the first lower end wall 126, the first side rail 152, and the bed frame 150. The first void 156 is sufficiently sized to accommodate the geometry of the manifold 108 in order to alleviate, reduce, or remove the excessive force between the manifold 108 and one or more of the plurality of inflatable air chambers 102 when the first lower end wall 126 expands towards the manifold 108. Since the manifold 108 is not provided proximate to the second side wall 132, the geometry of second side wall 132 is not required to accommodate the manifold 108, and may be asymmetrical with the first side wall 122. A second void 158 may be formed between the second side wall 132, the second side rail 153, and bed frame 150. In some embodiments, a first cross sectional area of the first void 156 is greater than a second cross sectional area of the second void 158.

In an embodiment of the disclosed subject matter, the first void 156 may be configured to accommodate the manifold 108 having a maximum manifold diameter $D_m$ (shown in FIG. 2) between about 3.25 inches and 3.5 inches.

Methods of Use

Figure 7:
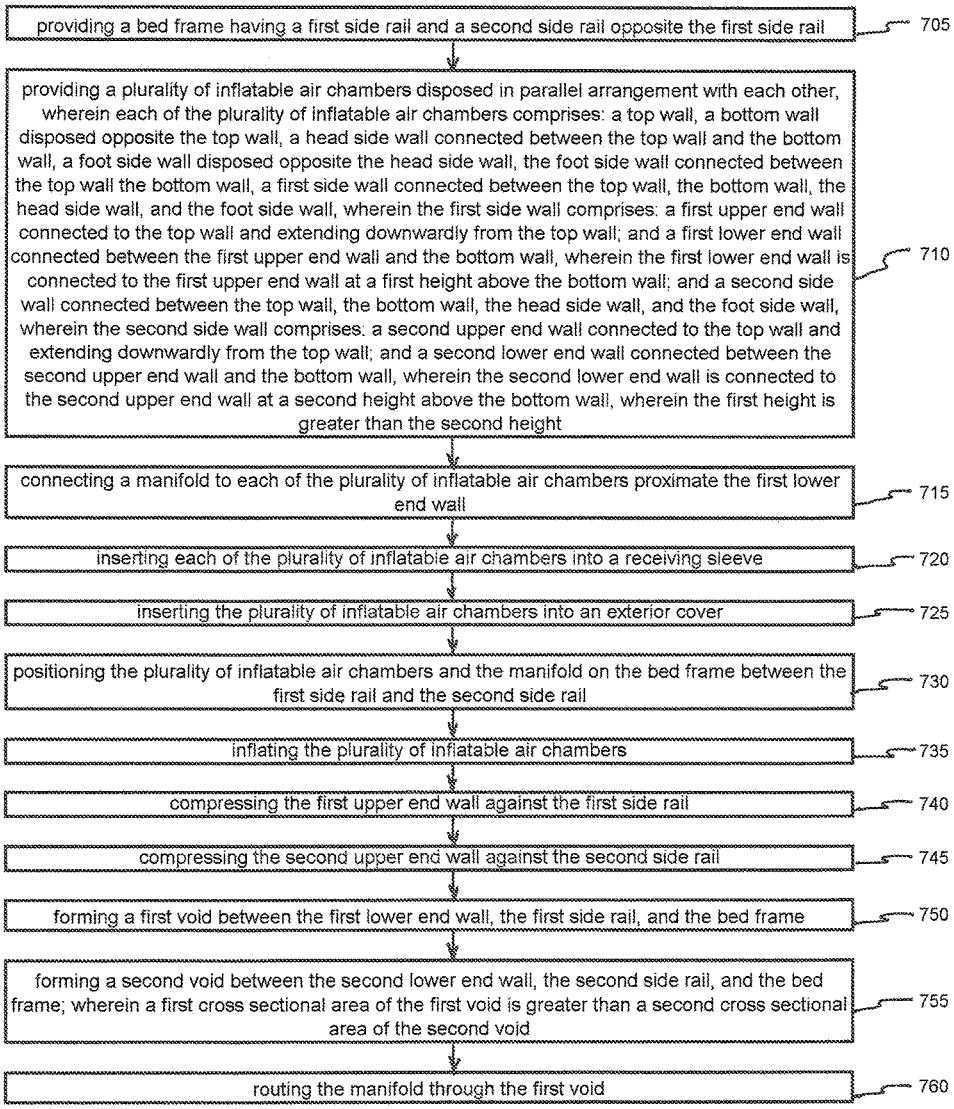
FIG. 7 is a flowchart illustrating a method of routing a manifold adjacent to a plurality of inflatable air chambers.

FIG. 7 is a flowchart illustrating a method for routing a manifold adjacent to a plurality of inflatable air chambers comprising the steps of:

At step 705, providing a bed frame having a first side rail and a second side rail opposite the first side rail.

At step 710, providing a plurality of inflatable air chambers disposed in parallel arrangement with each other, wherein each of the plurality of inflatable air chambers comprises: a top wall, a bottom wall disposed opposite the top wall, a head side wall connected between the top wall and the bottom wall, a foot side wall disposed opposite the head side wall, the foot side wall connected between the top wall the bottom wall, a first side wall connected between the top wall, the bottom wall, the head side wall, and the foot side wall, wherein the first side wall comprises: a first upper end wall connected to the top wall and extending downwardly from the top wall; and a first lower end wall connected between the first upper end wall and the bottom wall, wherein the first lower end wall is connected to the first upper end wall at a first height above the bottom wall; and a second side wall connected between the top wall, the bottom wall, the head side wall, and the foot side wall, wherein the second side wall comprises: a second upper end wall connected to the top wall and extending downwardly from the top wall; and a second lower end wall connected between the second upper end wall and the bottom wall, wherein the second lower end wall is connected to the second upper end wall at a second height above the bottom wall, wherein the first height is greater than the second height.

At step 715, connecting a manifold to each of the plurality of inflatable air chambers proximate the first lower end wall.

At step 720, inserting each of the plurality of inflatable air chambers into a receiving sleeve.

At step 725, inserting the plurality of inflatable air chambers into an exterior cover.

At step 730, positioning the plurality of inflatable air chambers and the manifold on the bed frame between the first side rail and the second side rail.

At step 735, inflating the plurality of inflatable air chambers.

At step 740, compressing the first upper end wall against the first side rail.

At step 745, compressing the second upper end wall against the second side rail.

At step 750, forming a first void between the first lower end wall, the first side rail, and the bed frame.

At step 755, forming a second void between the second lower end wall, the second side rail, and the bed frame; wherein a first cross sectional area of the first void is greater than a second cross sectional area of the second void.

At step 760, routing the manifold through the first void.

It is to be understood that while certain aspects of the disclosed subject matter have been shown and described, the disclosed subject matter is not limited thereto and encompasses various other embodiments and aspects.

Insofar as the description above and the accompanying drawings disclose any additional subject matter that is not within the scope of the single claim below, the inventions are not dedicated to the public and the right to file one or more applications to claim such additional inventions is reserved.

Having described the disclosed subject matter, what is claimed as new and desired to be secured by Letter Patents is:

1. A universal air surface comprising:
- a plurality of inflatable air chambers disposed in parallel arrangement with each other, wherein each of the plurality of inflatable air chambers comprises:
  - a top wall;
  - a bottom wall disposed opposite the top wall;
  - a head side wall connected between the top wall and the bottom wall;
  - a foot side wall disposed opposite the head side wall, the foot side wall connected between the top wall and the bottom wall;
  - a first side wall connected between the top wall, the bottom wall, the head side wall, and the foot side wall, wherein the first side wall comprises:
    - a first upper end wall connected to the top wall and extending downwardly from the top wall; and
    - a first lower end wall connected between the first upper end wall and the bottom wall, wherein the first lower end wall forms a first angle with the bottom wall, wherein the first upper end wall is approximately perpendicular to the bottom wall at the connection between the first upper end wall and the first lower end wall, wherein the first lower end wall is connected to the first upper end wall at a first height above the bottom wall, wherein the first angle is obtuse; and
  - a second side wall connected between the top wall, the bottom wall, the head side wall, and the foot side wall, wherein the second side wall comprises:
    - a second upper end wall connected to the top wall and extending downwardly from the top wall; and
    - a second lower end wall connected between the second upper end wall and the bottom wall, wherein the second lower end wall forms a second angle with the bottom wall, wherein the second upper end wall is approximately perpendicular to the bottom wall at the connection between the second upper end wall and the second lower end wall, wherein the second lower end wall is connected to the second upper end wall at a second height above the bottom wall, wherein the first height is greater than the second height.

2. The universal air surface of claim 1, wherein the first angle is greater than the second angle.

3. The universal air surface of claim 2, wherein the first angle is between about 110 degrees and 115 degrees.

4. The universal air surface of claim 3, wherein the first angle is about 112 degrees.

5. The universal air surface of claim 1, further comprising a manifold connected to each of the plurality of inflatable air chambers; wherein the manifold is disposed proximate the first lower end wall.

6. The universal air surface of claim 1, wherein a first void is formed between the first lower end wall, a bed frame, and a first side rail connected to the bed frame.

7. The universal air surface of claim 6, wherein the first void is configured to accommodate a manifold having a maximum manifold diameter between about 3.25 inches and 3.5 inches.

8. The universal air surface of claim 6, wherein a second void is formed between the second lower end wall, the bed frame, and a second side rail connected to the bed frame; wherein a first cross sectional area of the first void is greater than a second cross sectional area of the second void.

9. The universal air surface of claim 1, further comprising a receiving sleeve demountably connected to the plurality of inflatable air chambers.

10. The universal air surface of claim 9, further comprising an exterior cover demountably connected to the plurality of inflatable air chambers.

11. A universal air surface comprising:

a plurality of inflatable air chambers disposed in parallel arrangement with each other, wherein each of the plurality of inflatable air chambers comprises:

a top wall;

a bottom wall disposed opposite the top wall;

a head side wall connected between the top wall and the bottom wall;

a foot side wall disposed opposite the head side wall, the foot side wall connected between the top wall and the bottom wall;

a first side wall connected between the top wall, the bottom wall, the head side wall, and the foot side wall, wherein the first side wall comprises:

a first upper end wall connected to the top wall and extending downwardly from the top wall; and a first lower end wall connected between the first upper end wall and the bottom wall, wherein the first lower end wall forms a first angle with the bottom wall, wherein the first upper end wall is approximately perpendicular to the bottom wall at the connection between the first upper end wall and the first lower end wall, wherein the first lower end wall is connected to the first upper end wall at a first height above the bottom wall, wherein the first angle is obtuse; and a second side wall connected between the top wall, the bottom wall, the head side wall, and the foot side wall, wherein the second side wall comprises:

a second upper end wall connected to the top wall and extending downwardly from the top wall; and a second lower end wall connected between the second upper end wall and the bottom wall, wherein the second lower end wall forms a second angle with the bottom wall, wherein the second upper end wall is approximately perpendicular to the bottom wall at the connection between the second upper end wall and the second lower end wall, wherein the second lower end wall is connected to the second upper end wall at a second height above the bottom wall, wherein the first height is greater than the second height, wherein the first angle is between about 110 degrees and 115 degrees.

12. The universal air surface of claim 11, further comprising a manifold connected to each of the plurality of inflatable air chambers; wherein the manifold is disposed proximate the first lower end wall.

13. A method of a routing a manifold adjacent to a plurality of inflatable air chambers comprising the steps of:

providing a bed frame having a first side rail and a second side rail opposite the first side rail;

providing a plurality of inflatable air chambers disposed in parallel arrangement with each other, wherein each of the plurality of inflatable air chambers comprises:

a top wall;

a bottom wall disposed opposite the top wall;

a head side wall connected between the top wall and the bottom wall;

a foot side wall disposed opposite the head side wall, the foot side wall connected between the top wall and the bottom wall;

a first side wall connected between the top wall, the bottom wall, the head side wall, and the foot side wall, wherein the first side wall comprises:

a first upper end wall connected to the top wall and extending downwardly from the top wall; and a first lower end wall connected between the first upper end wall and the bottom wall, wherein the first lower end wall is connected to the first upper end wall at a first height above the bottom wall, wherein the first angle is obtuse; and a second side wall connected between the top wall, the bottom wall, the head side wall, and the foot side wall, wherein the second side wall comprises:

a second upper end wall connected to the top wall and extending downwardly from the top wall; and a second lower end wall connected between the second upper end wall and the bottom wall, wherein the second lower end wall is connected to the second upper end wall at a second height above the bottom wall, wherein the first height is greater than the second height;

connecting a manifold to each of the plurality of inflatable air chambers proximate the first lower end wall;

positioning the plurality of inflatable air chambers and the manifold on the bed frame between the first side rail and the second side rail;

inflating the plurality of inflatable air chambers;

compressing the first upper end wall against the first side rail;

compressing the second upper end wall against the second side rail;

forming a first void between the first lower end wall, the first side rail, and the bed frame; and routing the manifold through the first void.

14. The method according to claim 13, further comprising the step of forming a second void between the second lower end wall, the second side rail, and the bed frame; wherein a first cross sectional area of the first void is greater than a second cross sectional area of the second void.

15. The method according to claim 13, wherein the first lower end wall forms a first angle with the bottom wall, and the second lower end wall forms a second angle with the bottom wall, wherein the first angle is greater than the second angle.

16. The method according to claim 15, wherein the first angle is between about 110 degrees and 115 degrees.

17. The method according to claim 16, wherein the first angle is about 112 degrees.

18. The method according to claim 13, wherein the first void is configured to accommodate a manifold having a maximum manifold diameter between about 3.25 inches and 3.5 inches.

19. The method according to claim 13, further comprising the step of inserting each of the plurality of inflatable air chambers into a receiving sleeve.

20. The method according to claim 13, further comprising the step of inserting the plurality of inflatable air chambers into an exterior cover.

* * * * *